US007690143B2

(12) United States Patent
Kim et al.

(10) Patent No.: US 7,690,143 B2
(45) Date of Patent: Apr. 6, 2010

(54) AIR CONDITIONER

(75) Inventors: Ji Hoon Kim, Jinhae-si (KR); Joong Gil Yoo, Seongnam-si (KR); Ki Jung Yoo, Seoul (KR); Hee Jae Kwon, Seoul (KR); Kam Gye Lee, Pusan-si (KR); In Hee Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 801 days.

(21) Appl. No.: 11/327,334

(22) Filed: Jan. 9, 2006

(65) Prior Publication Data

US 2006/0150463 A1 Jul. 13, 2006

(30) Foreign Application Priority Data

Jan. 11, 2005 (KR) ..... 10-2005-0002697
Jan. 20, 2005 (KR) ..... 10-2005-0005194
May 31, 2005 (KR) ..... 10-2005-0045922

(51) Int. Cl.
*A47G 1/06* (2006.01)

(52) U.S. Cl. ..... 40/725; 40/724; 40/711; 62/263

(58) Field of Classification Search ..... 40/724, 40/725, 711; 62/263
See application file for complete search history.

(56) References Cited

U.S. PATENT DOCUMENTS 3,553,873 A * 1/1971 Weston ..... 40/711
4,332,114 A * 6/1982 Goebel et al. ..... 62/262
4,733,542 A * 3/1988 Blair ..... 62/263
4,785,562 A 11/1988 Good
5,373,654 A * 12/1994 Whalen ..... 40/716
5,509,225 A * 4/1996 Minh et al. ..... 40/606.02
6,018,955 A * 2/2000 Kaneko et al. ..... 62/125
6,922,930 B1 * 8/2005 Grayson ..... 40/711
2002/0189274 A1 * 12/2002 Lee et al. ..... 62/298
2003/0145618 A1 8/2003 Moon et al.

FOREIGN PATENT DOCUMENTS

| | | | |
|---|---|---|---|
| CN | 2287253 | Y | 8/1998 |
| CN | 2416565 | Y | 1/2001 |
| CN | 1401944 | A | 3/2003 |
| CN | 1405504 | A | 3/2003 |
| EP | 1 271 065 | A2 | 1/2003 |
| JP | 3-213921 | A | 9/1991 |
| JP | 5-187706 | A | 7/1993 |
| JP | 8-285318 | A | 11/1996 |
| JP | 9-89288 | A | 4/1997 |
| JP | 2003-213921 | A | 7/2003 |
| KR | 10-2002-0033880 | A | 5/2002 |
| KR | 10-200500-24798 | A | 3/2005 |
| WO | WO-03/014628 | A2 | 2/2003 |

* cited by examiner

*Primary Examiner*—Gary C Hoge
(74) *Attorney, Agent, or Firm*—Birch, Stewart, Kolasch & Birch, LLP

(57) ABSTRACT

An air conditioner is provided. In the air conditioner, a front frame is coupled to a front portion of a main body; a panel member is coupled to a front portion of the front frame; and an art panel detachably inserted into the panel member.

12 Claims, 20 Drawing Sheets

AIR CONDITIONER

BACKGROUND OF THE INVENTION

1. Field of the Invention

The present invention relates to an air conditioner, and more particularly, to an air conditioner that is designed to be associated with a picture or photograph, thereby providing an improved external appearance as well as its inherent air-conditioning effect.

2. Description of the Related Art

Generally, an air conditioner is operated as a refrigerant goes through a cooling cycle having a series of processes such as a compression process, a condensing process, an expanding process, and a vaporizing process. That is, after the refrigerant is compressed to a high temperature and pressure state, heat is discharged to an outer side by a condenser. Then, the temperature and pressure of the refrigerant are lowered as it goes through an expansion valve. Then, the refrigerant goes through the vaporizer to absorb heat and returns to the condenser.

Here, the compression, condensing and expansion processes are performed in an indoor unit of the air conditioner. The vaporizing process is performed by a blower fan and a heat exchanger.

Meanwhile, the air conditioner is generally classified into a window type air conditioner that is designed to be mounted on a window and to integrate a cooling cycle device therein and a sprit air conditioner having indoor and outdoor units that are separated from each other and installed on indoor and outdoor sides, respectively.

The sprit air conditioner is further classified according to an installing method of the indoor unit into a wall-mounted type, a standing type, a ceiling-mounted type, and a ceiling-buried type.

There is also provided a convertible type indoor unit that can be used any one of the wall-mounting type, the standing type and ceiling-mounted type.

Meanwhile, the indoor unit of the air conditioner is classified according to locations of air intake and outlet into a variety of types. For example, in a type where indoor air is introduced through a side portion of the indoor unit and exhausted through a front portion of the indoor unit, a louver is installed on the front portion of the indoor unit to uniformly distribute the air in the indoor room by rotating up and down and left and right.

In the typical indoor unit of the air conditioner, the front portion is designed to simply function as a cover. That is, a front cover defining the front portion of the indoor unit functions to prevent a variety of parts such as an air intake fan, a heat exchanger and the like that are installed inside the indoor unit to be exposed outward, thereby preventing a user from getting electric shock by touching the parts installed inside the indoor unit. That is, since the front cover is designed considering only the simple functions, it cannot affect on improving the interior atmosphere.

SUMMARY OF THE INVENTION

Accordingly, the present invention is directed to an air conditioner that substantially obviates one or more problems due to limitations and disadvantages of the related art.

An object of the present invention is to provide an air cleaner that is designed to be associated with a picture or photograph, thereby providing an improved external appearance as well as its inherent air-conditioning effect.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an air conditioner including: a main body; a front panel mounted on a front portion of the main body; and an art panel mounting unit located in front of the front panel to support an art panel having a picture or a photograph.

In another aspect of the present invention, there is provided an air conditioner including: a base; a front frame coupled to a front portion of the base; a panel member coupled to a front portion of the front frame; and an art panel detachably inserted into the panel member.

In still yet another aspect of the present invention, there is provided an air conditioner comprising: a base; a front frame coupled to a front surface of the base; a supporting panel detachably coupled to a front surface of the front frame; a transparent outer case coupled to a front surface of the supporting panel; an art panel inserted between the supporting panel and the outer case; and a mounting/dismounting member movably inserted in a rear frame portion of the outer case to couple and separate the supporting panel to or from the outer case.

In still another aspect of the present invention, there is provided an air conditioner including: a main body; and an art panel having a picture or a photograph and detachably coupled to a front portion of the main body.

According to the present invention, since an artwork or a picture can be displayed on the front portion of the indoor unit, the interior atmosphere can be improved.

Furthermore, when the front cover is formed of an LCD panel, digital pictures or photographs can be displayed through a slideshow.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
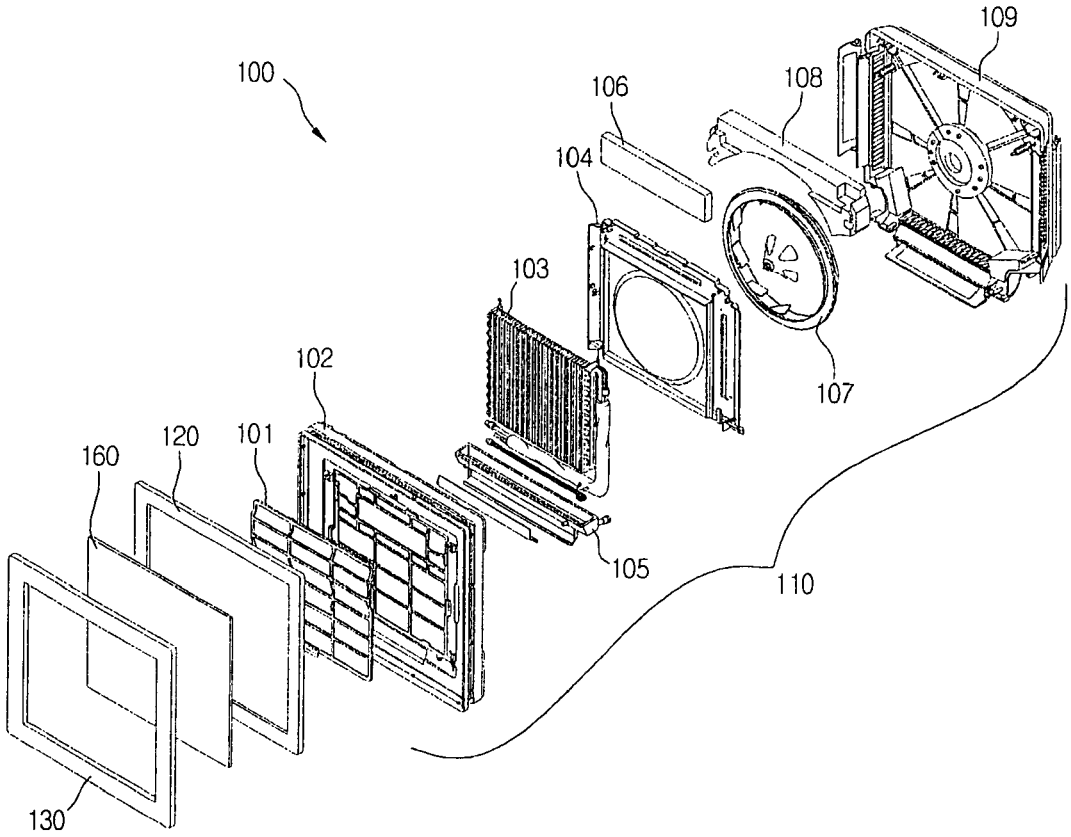
FIG. 1 is an exploded perspective view of an indoor unit of an air conditioner according to a first embodiment of the present invention.
Figure 2:
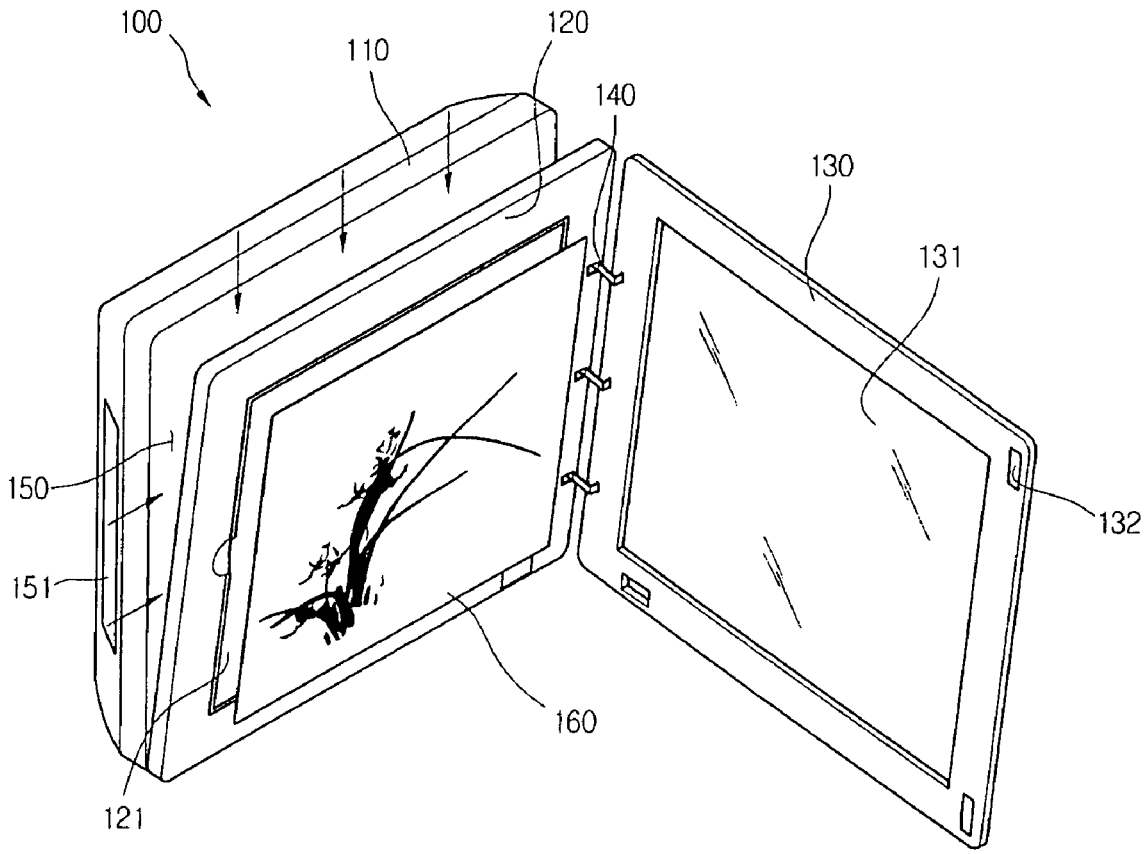
FIG. 2 is a perspective view illustrating an operation state of an indoor unit depicted in FIG. 1.

FIG. 1 is an exploded perspective view of an indoor unit of an air conditioner according to a first embodiment of the present invention and FIG. 2 is a perspective view illustrating an operation state of the indoor unit.

Referring to FIGS. 1 and 2, an indoor unit 100 of an air conditioner includes a main body 110 defining an outer appearance, a front panel mounted on a front surface of the main body with a predetermined gap, a front cover 130 detachably and pivotally attached on a front surface of the front panel 120, and an art panel 160 such as a picture or a photograph that is disposed between the front cover 130 and the front panel 120. The front panel 120 and the front cover 130 are coupled to each other by a hinge 140. Defined between the main body 110 and the front cover 130 is an air intake 150 through which the indoor air is introduced. Provided on a side portion of the main body 110 is more than one air outlet 151 through which the indoor air is exhausted. The front cover 130 is provided at a side with a mounting/dismounting portion 132 to which the front panel 120 can be mounted. A transparent window 131 is provided on an inner surface of the front cover 130 so that the art panel 160 can be seen through the same. The transparent window 131 functions to prevent the art panel from being stained by foreign objects.

The main body 110 of the indoor unit 100 includes a filter 101 mounted in rear of the front panel 120 to filter off foreign objects contained in the indoor air that is being introduced into the main body 110, a front frame 102 disposed in rear of the filter 101 to support the filter 101 and protect inner components, a base 109 coupled to the front frame 102, and a blower fan 107 disposed between the front frame 102 and the base 109.

The main body 11 further includes an heat exchanger 103 installed in front of the blower fan 107 to lower a temperature of the indoor air that is being introduced into the indoor unit 100, a drain pan 105 installed under the heat exchanger 103 to collect condensing water formed on a surface of the heat exchanger and dropt thereto, an orifice 104 mounted in rear of the heat exchanger 103 to guide the flow of the indoor air that is being introduced into the indoor unit 100, a ceiling portion 106 receiving a variety of electric components, and an passage guide 108 guiding the indoor air introduced by the blower fan 107 out of the indoor unit 100.

The operation of the above-described air conditioner will be described hereinafter.

When electric power is applied to the indoor unit 100, the air intake 150 is defined while the front panel 120 mounted on the front portion of the main body 110 is spaced away from the main body 110. The blower fan 107 mounted inside the main body 110 rotates to introduce the indoor air through the air intake 150. The indoor air being introduced passes through the filter 101 so that the foreign object contained in the indoor air can be filtered off by the filter 101. The indoor air further passes through the heat exchanger 103 to heat-exchange with a refrigerant. The indoor air having a lowered temperature while passing through the heat exchanger 103 is guided to the blower fan 170 by the orifice 104 and exhausted to the indoor side through the air outlet 151 while flowing along the passage guide 108 provided above the blower fan 107.

Meanwhile, the front panel 120 and the front panel 120 are detachably coupled to each other. The front panel 130 is pivotally coupled to the front panel 120 by the hinge 140. The mounting/dismounting member 132 is mounted on a rear portion of the front cover 130.

For example, the mounting/dismounting member 132 may be formed of a magnetic material and the front panel 120 may be formed of metal that can be adhered to the magnetic material. Thus, in order to dispose the art panel 160 on the front surface of the front panel 120, the user opens the front cover 130 by rotating the front cover by a predetermined angle and locates the art panel 160 on the front surface of the front panel 120, after which the user closes the front cover 130 by rotating the front cover to the initial position.

Describing in more detail, the mounting/dismounting member 132 formed of the magnetic material and attached on the rear portion of the front cover 130 is attached on the front portion of the front panel 120 to prevent the art panel 160 from being removed from the indoor unit 100. Preferably, the magnetic material of the mounting/dismounting member 132 has magnetic force that can sufficiently prevent the art panel 16 from being removed so that the user can easily open and close the front cover 130.

Figure 3:
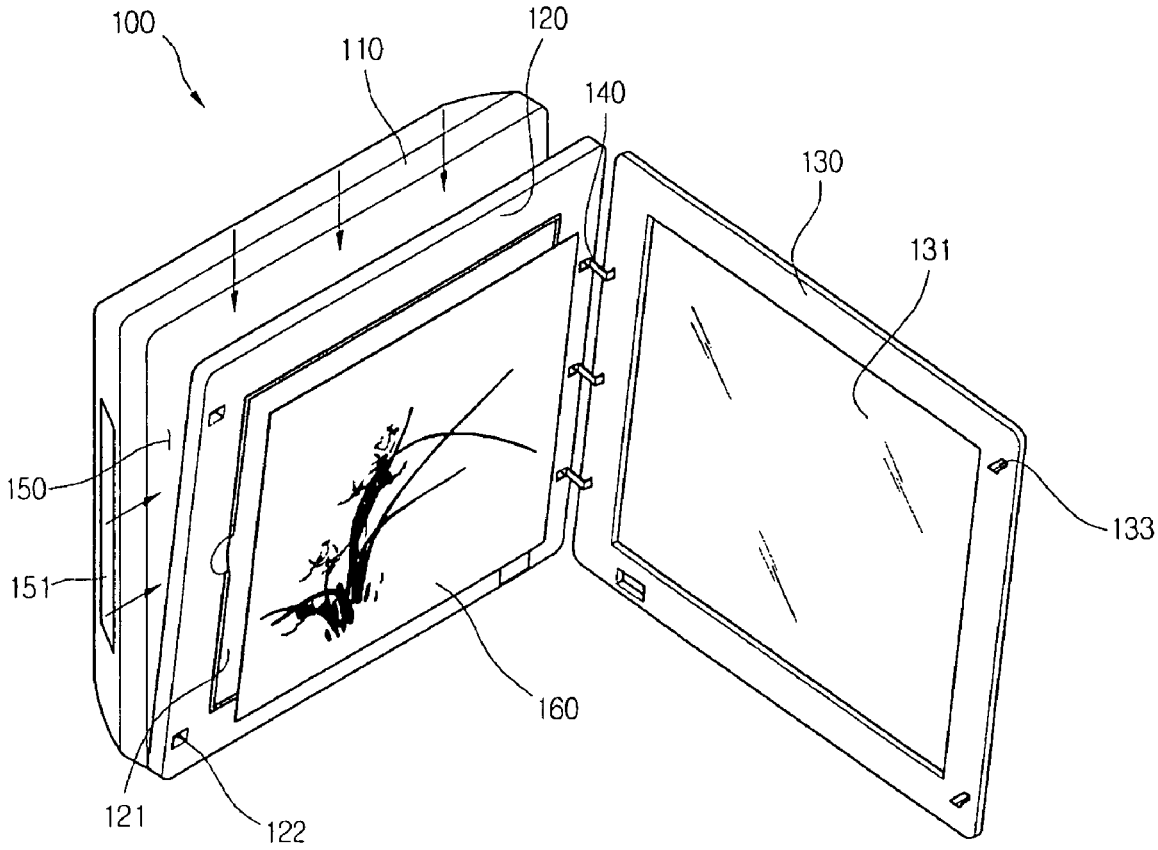
FIG. 3 is a perspective view of an indoor unit of an air conditioner according to a second embodiment of the present invention.

FIG. 3 is a perspective view of an indoor unit of an air conditioner according to a second embodiment of the present invention.

According to a feature of this embodiment, a mounting hook 133 is provided to couple the front cover 130 to the front panel.

That is, the front cover 130 is provided at a rear portion with the mounting hook 133 while the front panel 120 is provided at the front portion with a hook insertion groove 122 in which the mounting hook 133 can be inserted.

By pulling the front cover 130 frontward, the mounting hook 133 is released from the hook insertion groove 122. After the art panel 160 is disposed on the front surface of the front panel 120, the front cover 130 is closed by the insertion of the mounting hook 133 into the hook insertion groove 122. Here, when the mounting hook 133 is completely inserted into the hook insertion groove 122, a snapping sound is generated so that the user can identify whether the front cover 130 is completely coupled to the front panel 120, thereby improving the coupling liability.

Means for coupling the front cover 130 to the front panel 120 is not limited to the above-described cases. A variety of modification may be possible. For example, the locations of the mounting hook 133 and the hook insertion groove 122 may alter.

Figure 4:
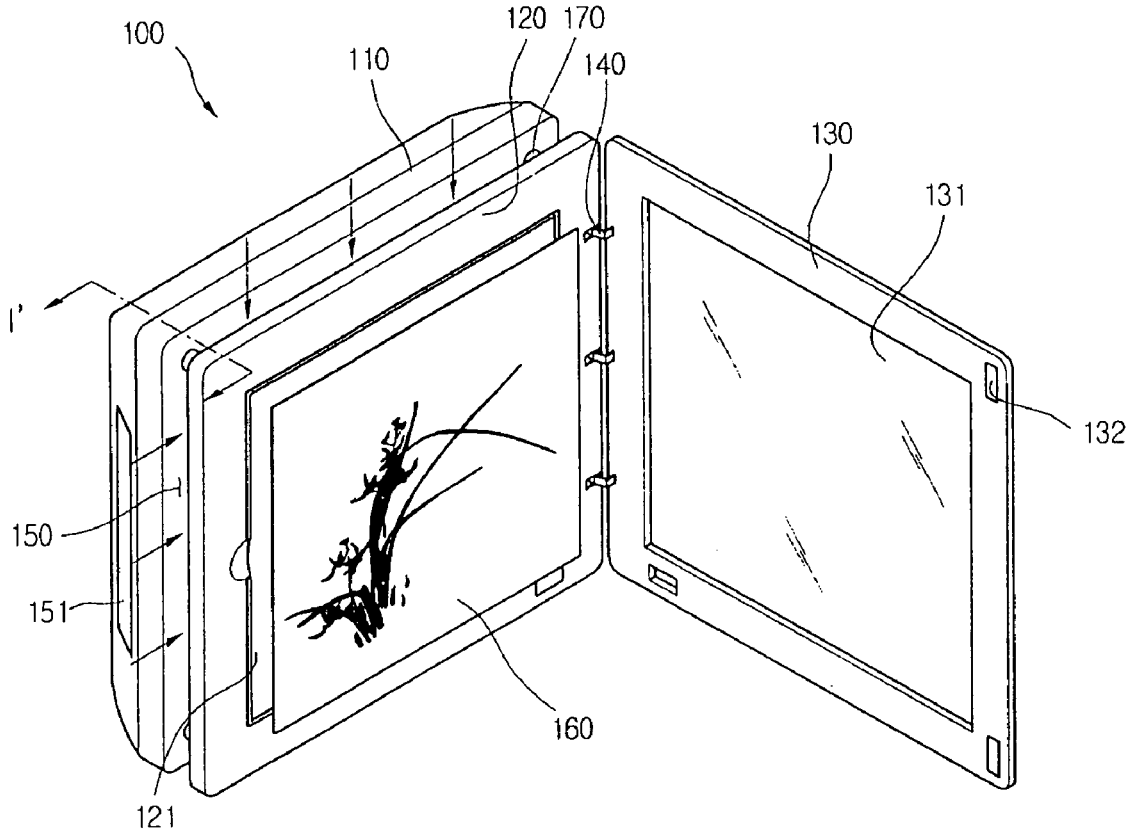
FIG. 4 is a perspective view of an indoor unit of an air conditioner according to a third embodiment of the present invention.
Figure 5:
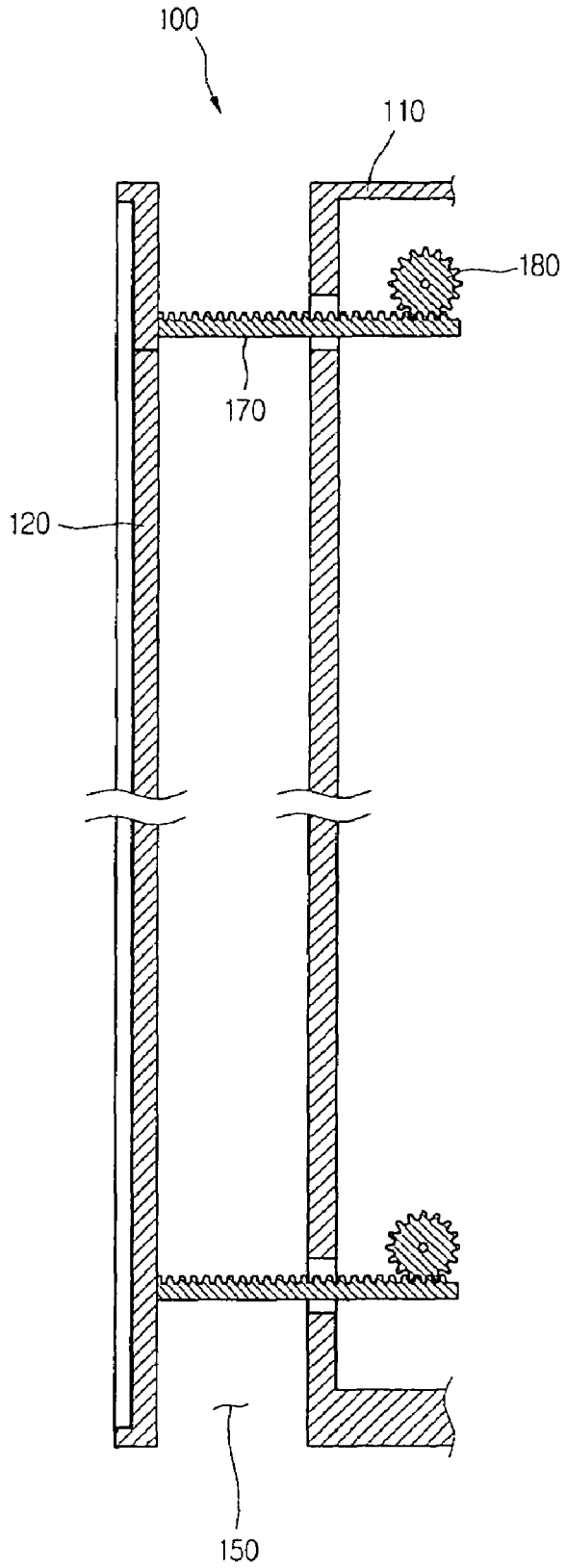
FIG. 5 is a sectional view taken along line I-I' of FIG. 4.

FIG. 4 is a perspective view of an indoor unit of an air conditioner according to a third embodiment of the present invention and FIG. 5 is a sectional view taken along line I-I' of FIG. 4.

Referring to FIGS. 4 and 5, a sliding member 170 that can reciprocate frontward and rearward may be connected to the rear portion of the front panel 120. That is, by the reciprocating motion of the sliding member 170, the front panel 120 moves frontward and rearward, thereby selectively forming the air intake.

Describing in more detail, the sliding member 170 may be inserted into or projected out of the main body 110. The sliding member 170 is engaged with pinion gears 180 mounted inside the main body 110.

That is, the sliding member 170 is formed of rack gears engaged with the respective pinion gears 180 so that it can reciprocate by the rotation of the pinion gears 180. The pinion gears 180 are designed to reversibly rotate by a step motor. The step motor for rotating the pinion gear 180 may be provided for each pinion gear. Alternatively, the pinion gears may be driven by a single step motor.

As described in the first embodiment, in the case where the indoor unit has the front panel 120 that is designed to pivot around a rotational shaft, since the art panel 160 is inclined to a side in a state where the indoor unit 100 is operated, the user cannot easily enjoy the work on the art panel 160. However, in this embodiment, since the front panel 120 is designed to reciprocate frontward or rearward in a state where it is positioned in a vertical direction, the user can effectively enjoy the work on the art panel 120. Furthermore, by the reciprocating motion, the air intake 150 can be effectively formed between the main body 110 and the front panel 120, the indoor air can be introduced into the indoor unit 100 through top, bottom and both sides of the indoor unit 100.

Figure 6:
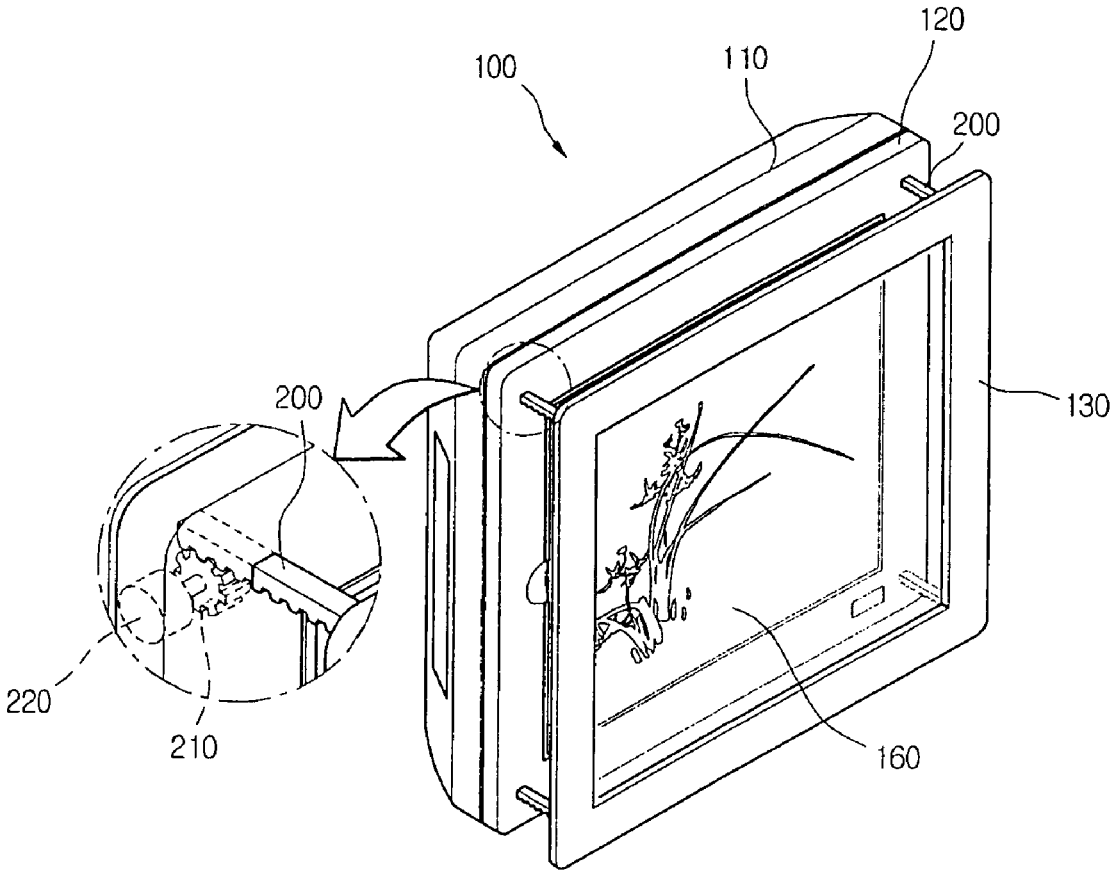
FIG. 6 is a perspective view of an indoor unit of an air conditioner according to a fourth embodiment of the present invention.

FIG. 6 is a perspective view of an indoor unit of an air conditioner according to a fourth embodiment of the present invention.

According to a feature of this embodiment, the front cover 130 is designed to move away from the front panel 120 by a predetermined distance.

That is, a rack gear 200, a pinion gear 210 engaged with the rack gear 200 and a reversible step motor 220 driving the pinion gear 210 are installed inside the front panel 120. The rack gear 200 is provided by more than one on a corner portion of the front panel 120 and the front cover 130 is connected to an end portion of the rack gear 200. A control button (not shown) for controlling the operation of the step motor 220 may be provided on a side of the main body 110 or the front panel 120.

In order to dispose the art panel 160 on the front surface of the indoor unit 100, the user pushes the control button. Then, the step motor 220 rotates and thus the pinion gear 210 rotates therewith. As a result, the rack gear 200 engaged with the step motor 220 moves frontward, thereby moving the front cover 130 connected to the rack gear 200 frontward to move away from the front panel 120. Then the user disposes the art panel 160 on the front surface of the front panel 120 through a gap defined between the front panel 120 and the front cover 130, after which the user pushes the control button to reversibly rotate the step motor 220. As a result, the pinion gear 210 reversible rotates to allow the rack gear 200 to be inserted inside the front panel 120, thereby allowing the front cover 130 to closely contact the front panel 120.

Figure 7:
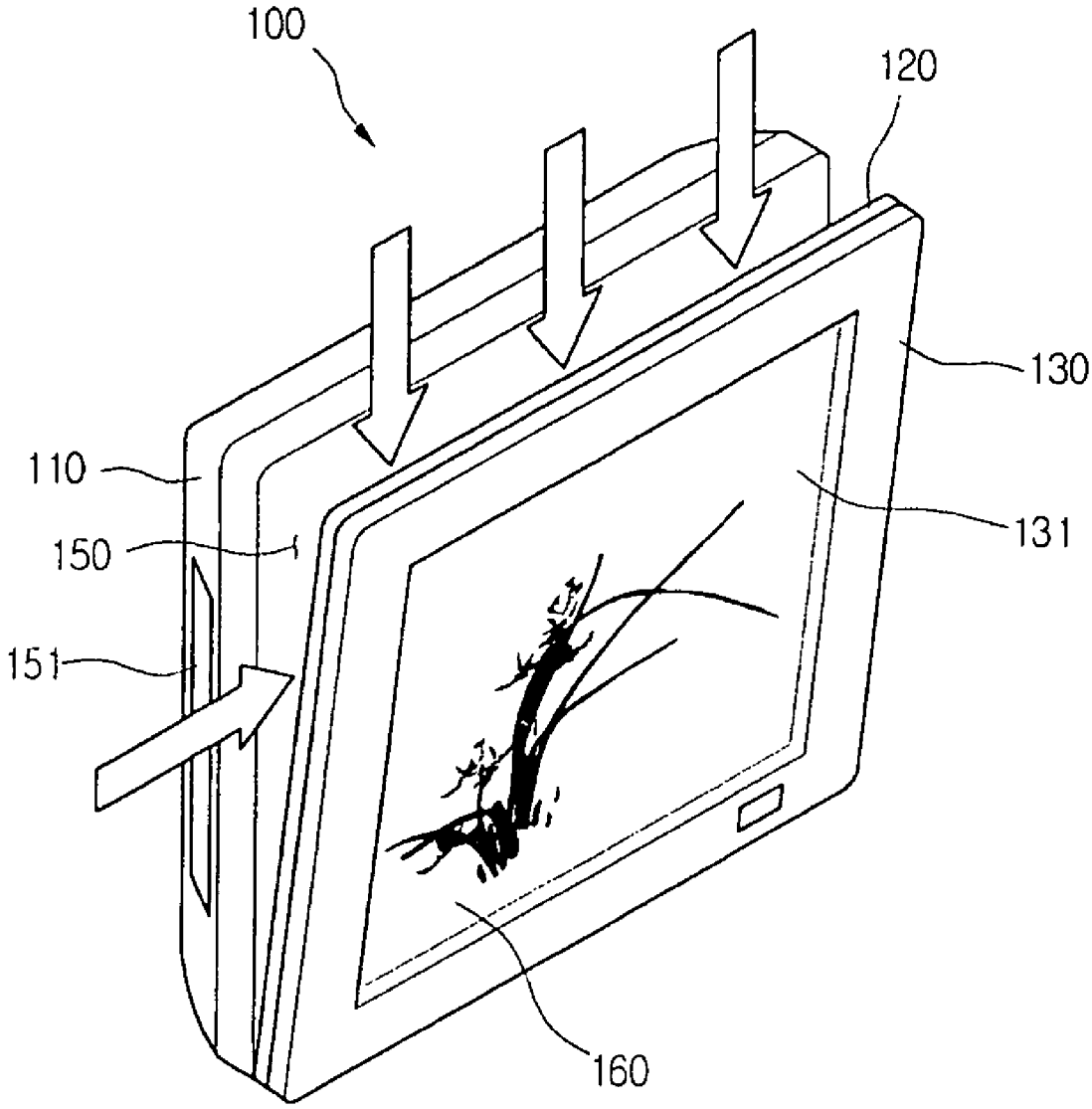
FIG. 7 is a perspective view of an indoor unit of an air conditioner according to a fifth embodiment of the present invention; to 5.

FIG. 7 is a perspective view of an indoor unit of an air conditioner according to a fifth embodiment of the present invention.

According to a feature of this embodiment, a transparent window 131 is attached on the front cover 130 and the front cover 130 is integrally formed with the front panel 120. In addition, the art panel 160 is inserted through a side of the front cover 130.

That is, the front panel 120 may be designed to rotate by a predetermined angle from the main body to define the air intake 150 or to move away from the main body 110 to define the air intake 150. The front cover 130 is provided with an art panel insertion slot 134 on side ends thereof so that the art panel 160 can be inserted therethrough.

Figure 8:
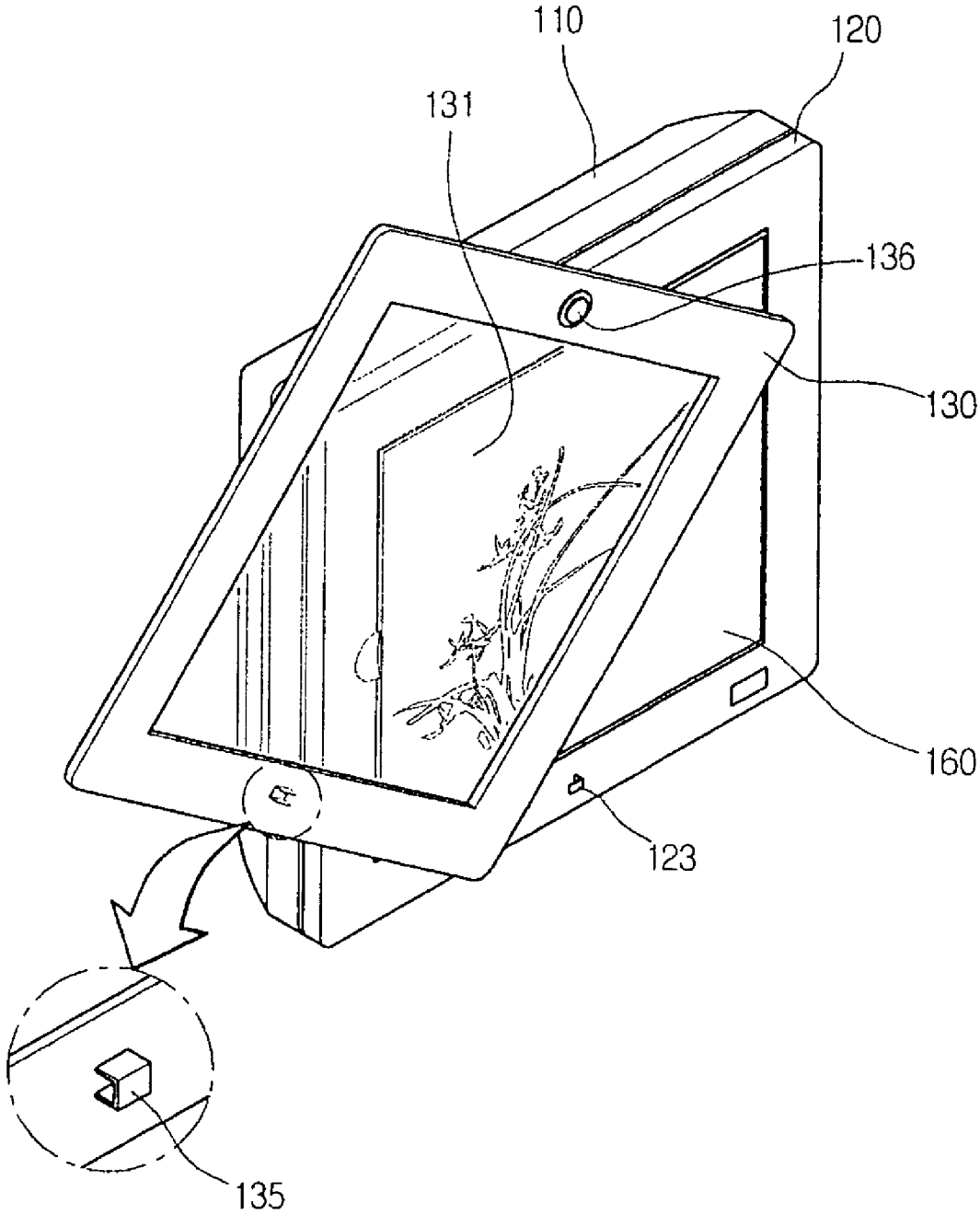
FIG. 8 is a perspective view of an indoor unit of an air conditioner according to a sixth embodiment of the present invention.

FIG. 8 is a perspective view of an indoor unit of an air conditioner according to a sixth embodiment of the present invention.

According to a feature of this embodiment, the front cover 130 with the transparent window 131 is coupled to the front panel 120 to be capable of pivoting around a shaft fixed on a side of the front panel 120.

That is, the front cover 130 is coupled to a pivotal shaft 136 formed on an upper portion of the front panel 120 so that it can rotates leftward or rightward when it is intended to dispose the art panel 160. The front cover 130 is designed to pivot by 360° around the pivotal shaft 136. A hook loop 135 that is designed to be fixed on the front panel 120 is formed on a lower portion of the front cover 130.

The front panel 120 is provided at a front portion with a hook end 123 coupled to the hook loop 135 to prevent the front cover 130 from moving.

The art panel 160 is disposed on the front surface of the front panel 120 after the front cover 130 is pivoted in a direction. After disposing the art panel 160, the front cover 130 is pivoted to the initial position so that the hook loop 135 is hooked on the hook end 123. Here, the pivotal shaft 136 may be formed on the upper or side portion of the front panel 120. Preferably, the pivotal shaft 136 is formed on the side portion of the front panel 120 and the hook end 123 is formed facing the pivotal shaft 136. At this point, a bent portion is oriented upward. Then, the hook loop 135 is hooked on the hook end 123 while descending downward by the self-gravity of the front cover 130. Thus, no gap between the front cover 130 and the front panel 120 is formed.

Figure 9:
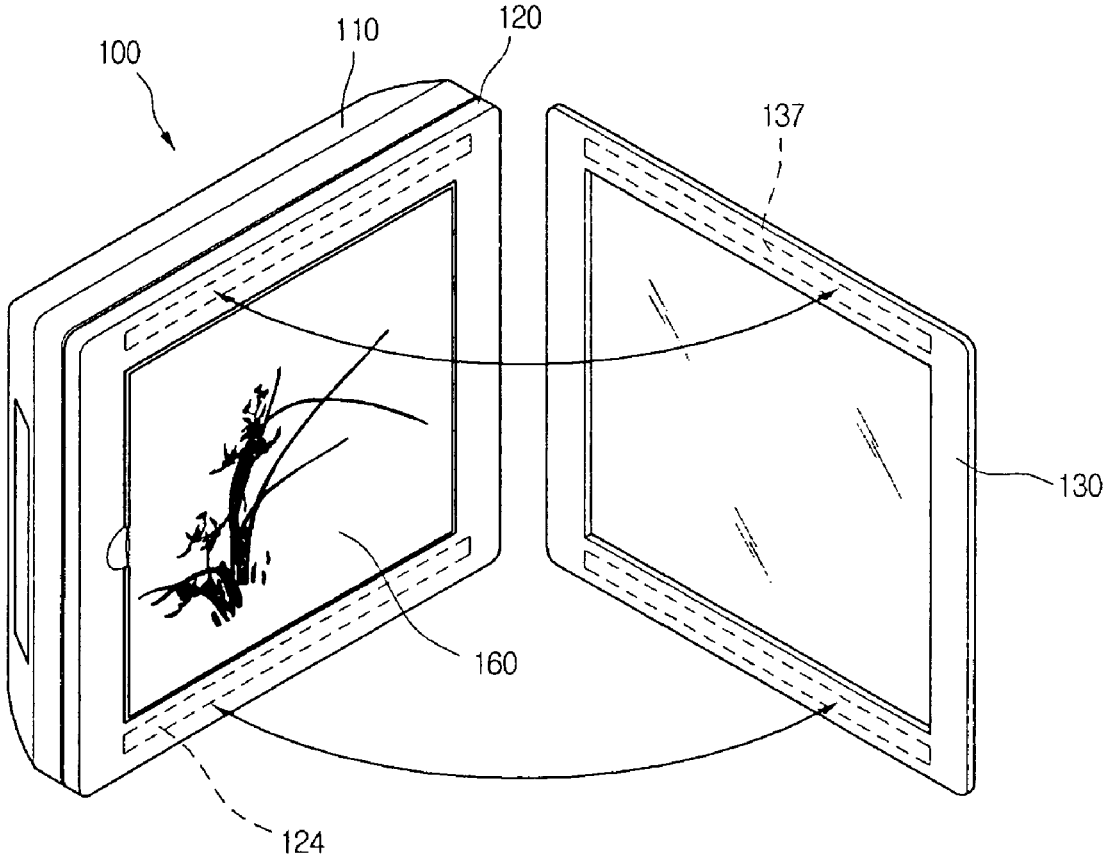
FIG. 9 is a perspective view of an indoor unit of an air conditioner according to a seventh embodiment of the present invention.

FIG. 9 is a perspective view of an indoor unit of an air conditioner according to a seventh embodiment of the present invention.

According to a feature of this embodiment, the front cover 130 is designed to be completely separable from the panel 120.

That is, a magnet 137 is provided on a rear portion of the front cover 130 and a magnet 124 having an opposite polarity to that of the magnet 137 of the front cover 130 is provided on a front portion of the front panel 120. Therefore, in order to dispose the art panel on the front surface of the front panel 120, the user separates the front cover 130 from the front panel 120 by pulling the front cover 130 using force higher than the magnetic force applied between the magnets 137 and 124. After disposing the art panel 60, the user attaches the front cover 130 on the front panel using the magnetic force between the magnets 137 and 124.

Figure 10:
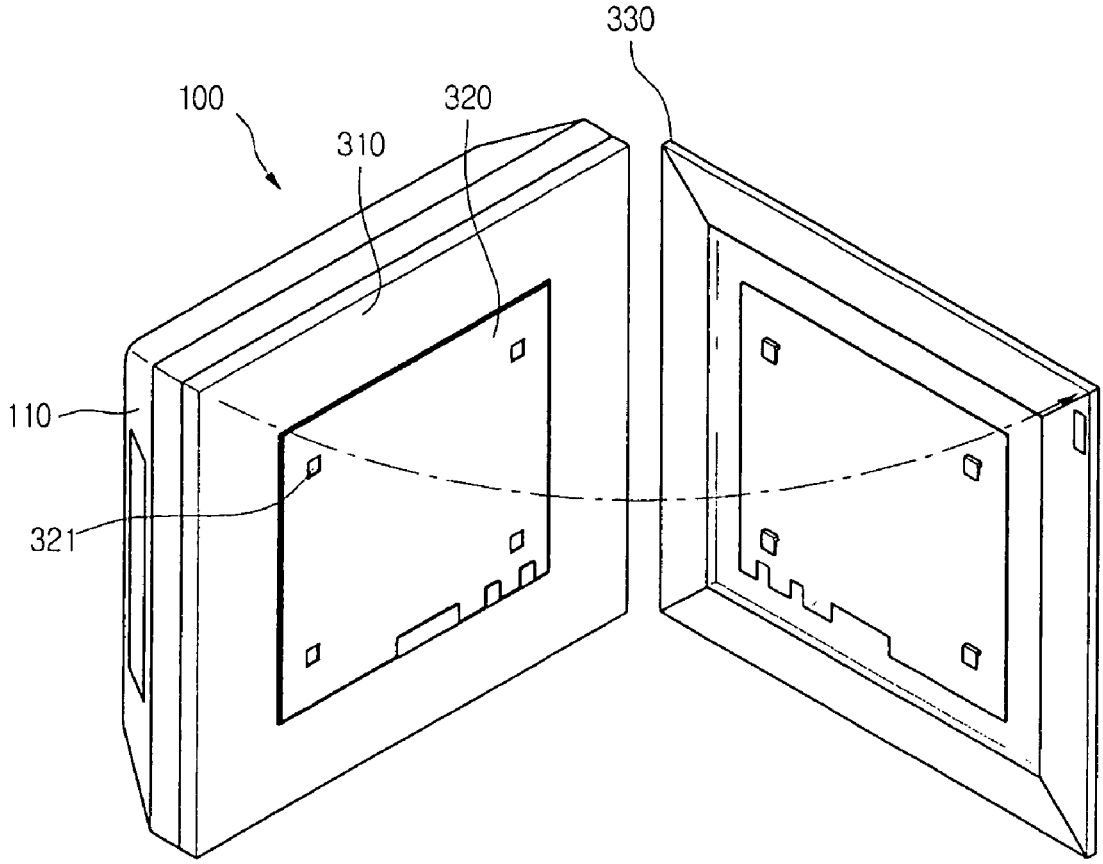
FIG. 10 is a perspective view of an indoor unit of an air conditioner according to an eighth embodiment of the present invention.
Figure 11:
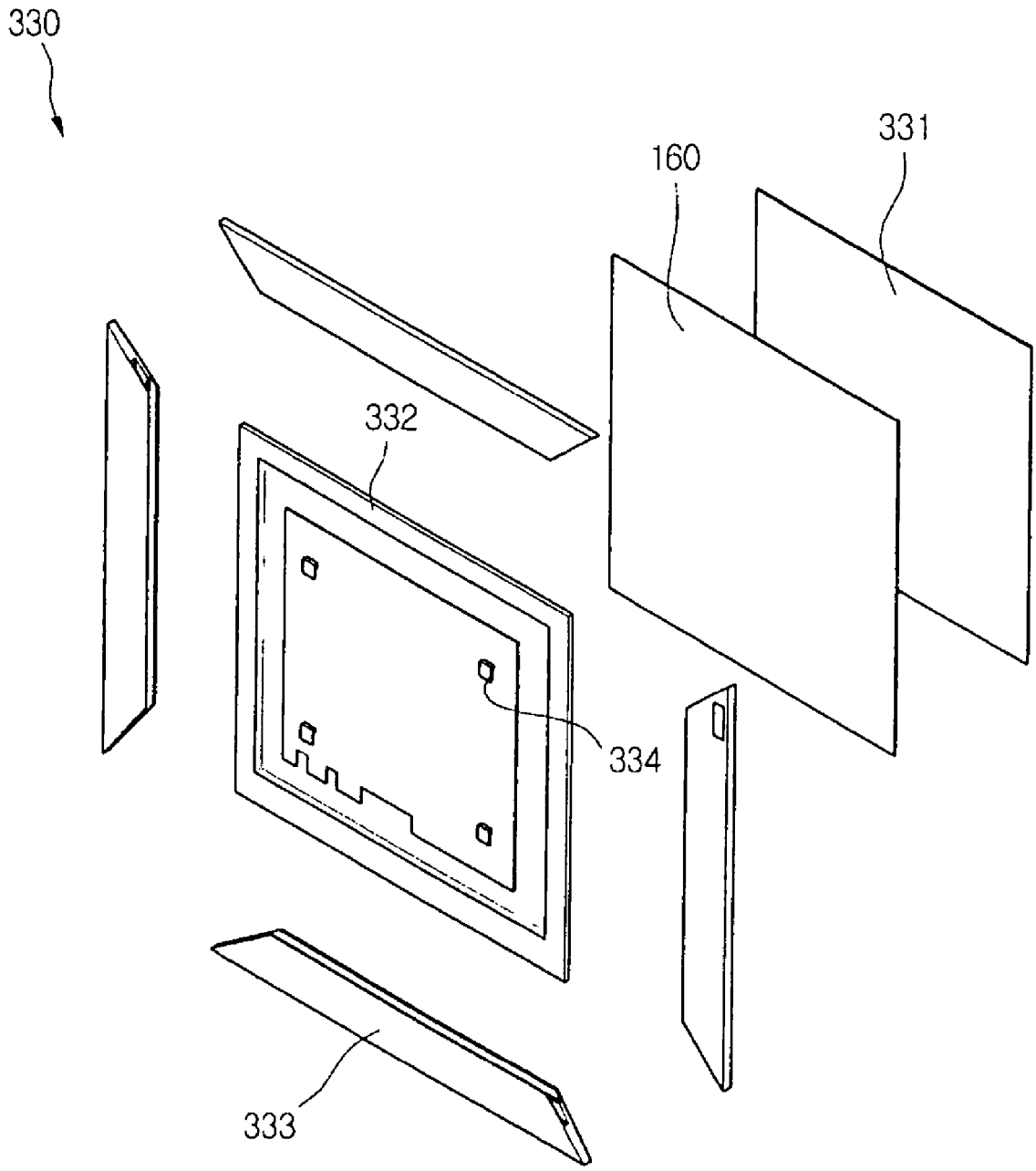
FIG. 11 is a perspective view of a panel member according to the present invention.

FIG. 10 is an exploded perspective view of an indoor unit of an air conditioner according to an eighth embodiment of the present invention and FIG. 11 is an exploded perspective view of a panel member.

Referring to FIGS. 10 and 11, an indoor unit 100 of this embodiment includes a main body 110, a panel frame 310 mounted on a front portion of the main body 110, a front panel 320 provided inside the panel frame 310, a front cover 330 detachably mounted on the front panel 320, and an art panel 160 inserted inside the front cover 330.

The indoor unit of this embodiment is identical to that of the seventh embodiment except for a mounting method of the front cover 330 on the front panel 320.

That is, the front panel 330 is formed in a picture frame type so that the art panel 160 can be disposed therein after it is completely separated from the main body 110.

The front cover 330 includes a transparent window 331 disposed in front of the art panel 160, a supporting frame 332 coupled to a rear portion of the window 331 to support the art panel 160, and a side frame 333 coupled to edges of the supporting frame 332 and the window 331 to integrally couple the supporting frame 332 to the window 331. A gap through which the art panel 160 can be inserted is formed between the supporting frame 332 and the window 331. The side frame 333 can be formed of one or more sections that are designed to be separated from the frame 332 and the window 331 so that the art panel 160 can be replaced. Preferably, a section coupled to the upper portion of the front cover 330 is designed to be separated so that the art panel 160 can be removed and inserted through the upper potion, thereby preventing the side frame 333 from being removed from the main body 110 by the self-gravity. The side frame 333 is provided at an inner portion with a groove having a predetermined width and depth. The edge portions of the window 331, the supporting panel 332 and the art panel 160 are inserted into the groove. The groove is designed having a width that can allow the window 331, the supporting panel 332 and the art panel 160 to tightly contact the side frame 333, thereby preventing the art panel 160 from moving between the window 331 and the supporting panel 332.

Meanwhile, as described in the first and second embodiments, the front panel is designed to be opened and closed by rotating around a hinge shaft or to define an air intake by a sliding motion forward. More than one mounting loop 334 is provided on a rear portion of the supporting panel 332 of the front cover 330 and more than one mounting hole 321 to which the mounting loop 334 is hooked is formed on a front portion of the front panel 320. Therefore, the insertion of the mounting loop 334 into the mounting hole 321 enhances the coupling force of the front cover 330 to the front panel 320. Alternatively, a hook method may be used instead of using the mounting loop 334. The magnet may be formed in a strip shape formed along the edges of the rear portion of the supporting panel 332 and the front portion of the front panel 320 so that the front cover 330 can be coupled to the front panel 320 by the magnetic force.

Figure 12:
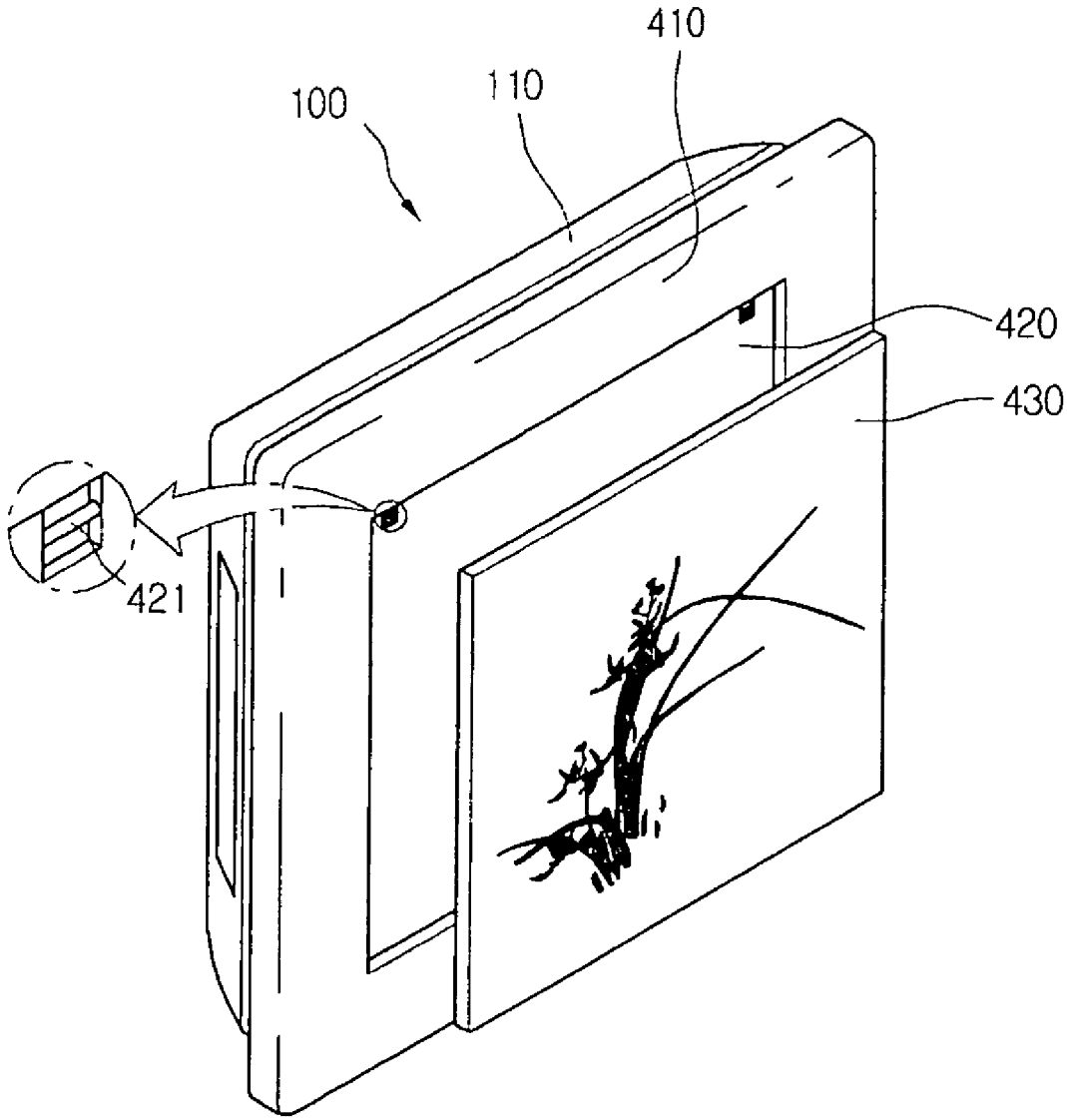
FIG. 12 is a perspective view of an indoor unit of an air conditioner according to a ninth embodiment of the present invention.
Figure 13:
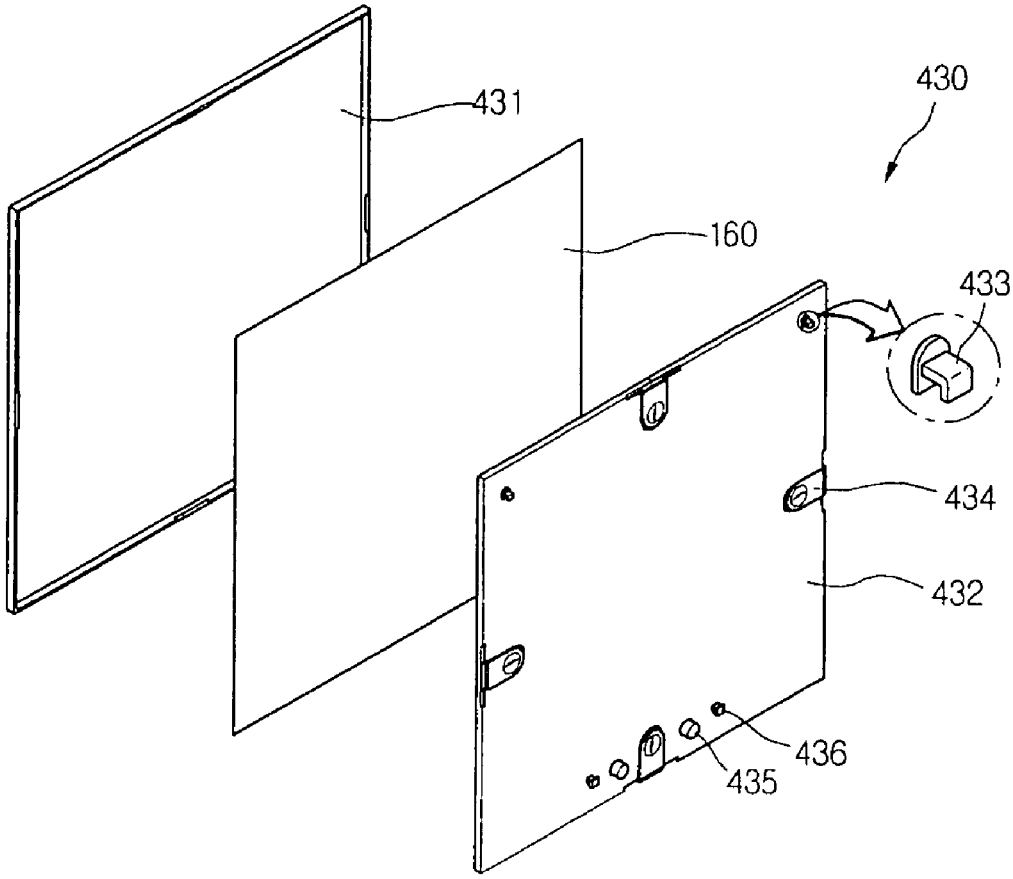
FIG. 13 is an explode perspective view of a front cover that can be mounted on an indoor unit according to the present invention.

FIG. 12 is a perspective view of an indoor unit of an air conditioner according to a ninth embodiment of the present invention and FIG. 13 is an explode perspective view of a front cover that can be mounted on an indoor unit according to the present invention.

Referring to FIGS. 12 and 13, an indoor unit 100 of this embodiment includes a main body 110, a panel frame 190 mounted on a front portion of the main body 100, a front panel 420 mounted on the panel frame 190 to be capable of pivoting by predetermined angle and reciprocating frontward and rearward, and a front cover 430 coupled to a front portion of the front panel 420.

The front cover 430 includes a transparent outer case 431 and a supporting panel 432 coupled to a rear portion of the outer case 431. An art panel 160 is inserted between the outer 431 and the supporting panel 432. Therefore, the art panel 106 can be protected by the outer case 431 and displayed for the user.

More than one mounting/dismounting member 434 is formed on a rear portion of the supporting panel 432 to securely couple the supporting panel 432 to the outer case 431. The mounting/dismounting member 434 is formed to be movable in a radial direction. That is, when the mounting/dismounting member 434 is pushed toward the center, the supporting panel 432 is separated from the outer case 431. In this state, the art panel 160 is inserted and the mounting/dismounting member 434 is pushed toward the edge to be coupled to the outer case 431. Means for coupling the outer case 431 to the supporting panel 432 is not limited to this embodiment. That is, a variety of coupling means such as a rotational loop or hook can be applied. In addition, other coupling means will be included in the scope of the present invention.

In addition, a hook loop 433 is formed on an edge of the rear portion of the supporting panel 432 to couple the front cover 430 to the front panel 420. A hook end 421 is formed on the front portion of the front panel. The hook end 421 is designed to be rotatably inserted in the hook loop 433. The supporting panel 432 is provided at the rear portion with coupling means such as a magnet 435 and a hook 436 that correspond to the hook loop 433. The front panel 420 is provided at the front portion with a magnet having a polarity opposite to that of the magnet 435. By providing the magnet 435 and the hook 436, the front cover 430 can closely contact the front panel 420. The front cover 430 is capable of rotating around the rotational shaft defined by the hook end 421. By completely separating the hook loop 433 from the hook end 421, the front cover 430 can be separated from the front panel 420. Means for coupling the outer case 431 to the supporting panel 432 is not limited to this embodiment. That is, a variety of coupling means can be applied, being included in the scope of the present invention.

The air intake is formed by the pivotal motion of the front panel 420 around a hinge shaft or the movement of the front panel 420 frontward. Therefore, an additional description of the moving method of the front panel 420 will be omitted herein.

Alternatively, a panel frame 190 may be mounted on a front edge of the indoor unit 100. The panel frame 190 may be formed of a transparent material. In addition, a light emission member may be installed on the panel frame 190 or inside the main body 110 so that the light emitted from the light emission member can be transmit the panel frame 190. By making the light emitted from the edge of the indoor unit 100, the interior atmosphere can be further improved. Furthermore, the emitted light can be dispersed toward the art panel 160, thereby improving the property of the picture or photograph on the art panel. Alternatively, the panel frame 190 may be formed of a luminous material. In this case, the light can be emitted without installing additional light emission member. The panel frame 190 is detachably coupled to the main body so that it can be replaced.

Figure 14:
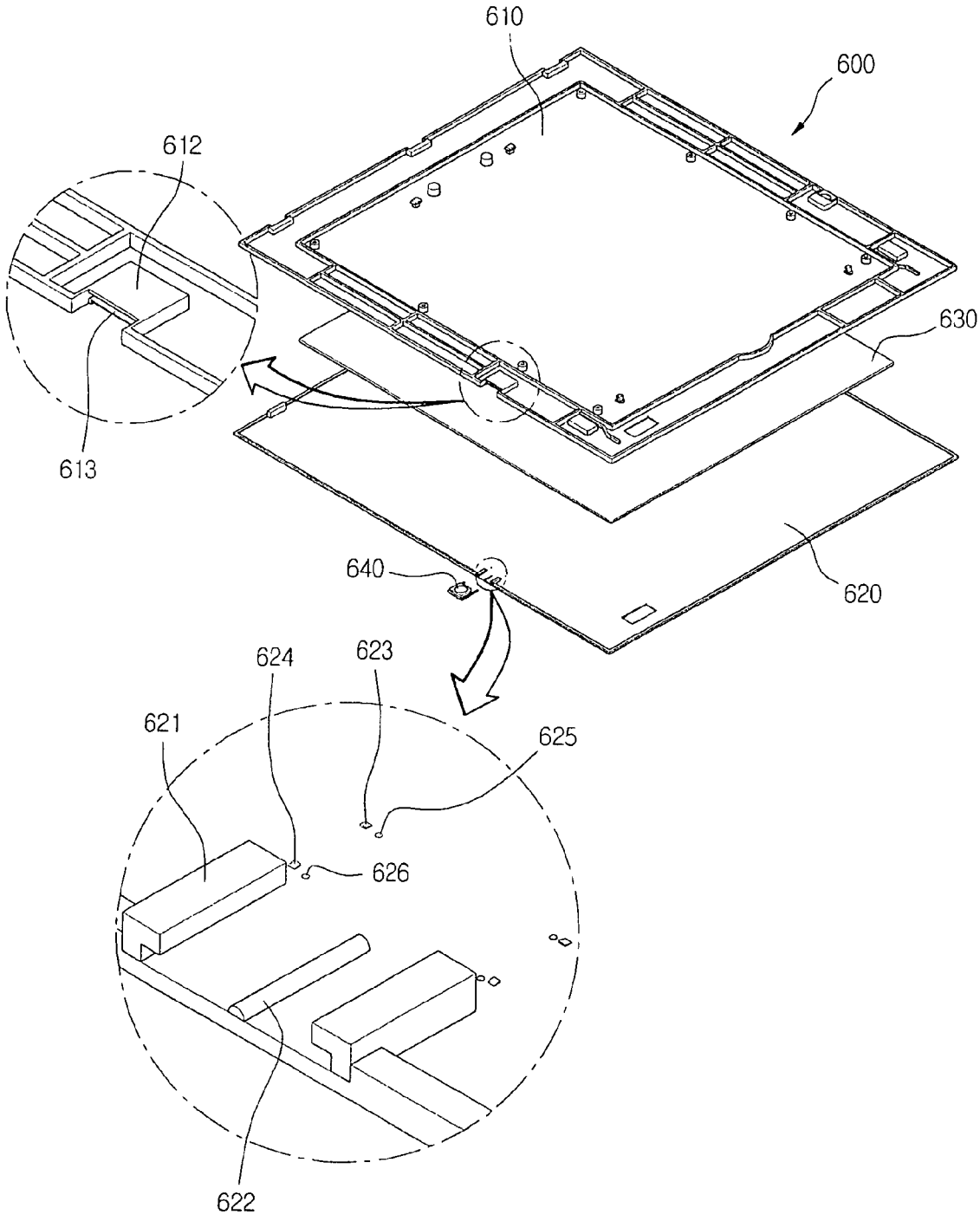
FIG. 14 is an exploded perspective view of an example of a front cover according to a ninth embodiment of the present invention.

FIG. 14 is an exploded perspective view of an example of a front cover according to a ninth embodiment of the present invention.

Referring to FIG. 14, a front cover 60 includes a transparent outer case 620, a supporting panel 610 coupled to a rear surface of the outer case 62, an art panel 630 inserted between the outer case 620 and the supporting panel 610, and a mounting/dismounting member 640 movably inserted on a side frame portion of the outer case 620.

Describing in more detail, two or more mounting/dismounting members 640 may be provided at an opposing portion between the supporting panel 610 and the outer case 620 so that the supporting panel 610 and the outer case 620 can be stably coupled to each other.

Meanwhile, the frame portion of the supporting panel 610 is provided with an insertion portion 612 in which the mounting/dismounting member 640 is inserted and a limit setting rib 613 for setting an insertion limitation of the mounting/dismounting member 640. That is, the limit setting rib 613 is formed to be spaced away from a top surface of the insertion portion 612 by a predetermined distance to allow a portion of the body 646 (see FIG. 15) of the mounting/dismounting member to be inserted into a space between the limit setting rib 613 and the top surface of the insertion portion 612.

The rear frame portion of the outer case 620 is provided with a side guide rib 621 for supporting both side edges of the mounting/dismounting member 640 and a center guide rib 622 inserted in a guide groove 645 formed on a center portion of the mounting/dismounting member 640.

Describing in more detail, as the mounting/dismounting member 640 is guided by the side guide rib 621 and the center guide rib 622, a longitudinal movement of the mounting/dismounting member 640 can be stably realized.

Also, the rear frame portion of the outer case 620 is further provided with an insertion stopper 623 for setting an insertion limitation of the mounting/dismounting member 640 and a withdrawal stopper 624 for setting a withdrawing limitation of the mounting/dismounting member 640. The insertion and withdrawal stoppers 623 and 624 are formed to be spaced apart from an end of the side guide rib 612. The insertion and withdrawal stoppers 623 and 624 are arranged on an identical line and spaced apart from each other by a predetermined distance.

A rear surface of the outer case 620 is provided with an insertion-fixing groove 625 allowing the mounting/dismounting member 640 to be fixed in a state where it is inserted in an insertion portion of the outer case and a withdrawal-fixing groove 626 allowing the mounting/dismounting member 640 to be fixed in a state where it is withdrawn from the insertion portion of the outer case the 6. The insertion and withdrawal grooves 625 and 626 are formed to be closer to the insertion and withdrawal stoppers 623 and 624, respectively.

Figure 15:
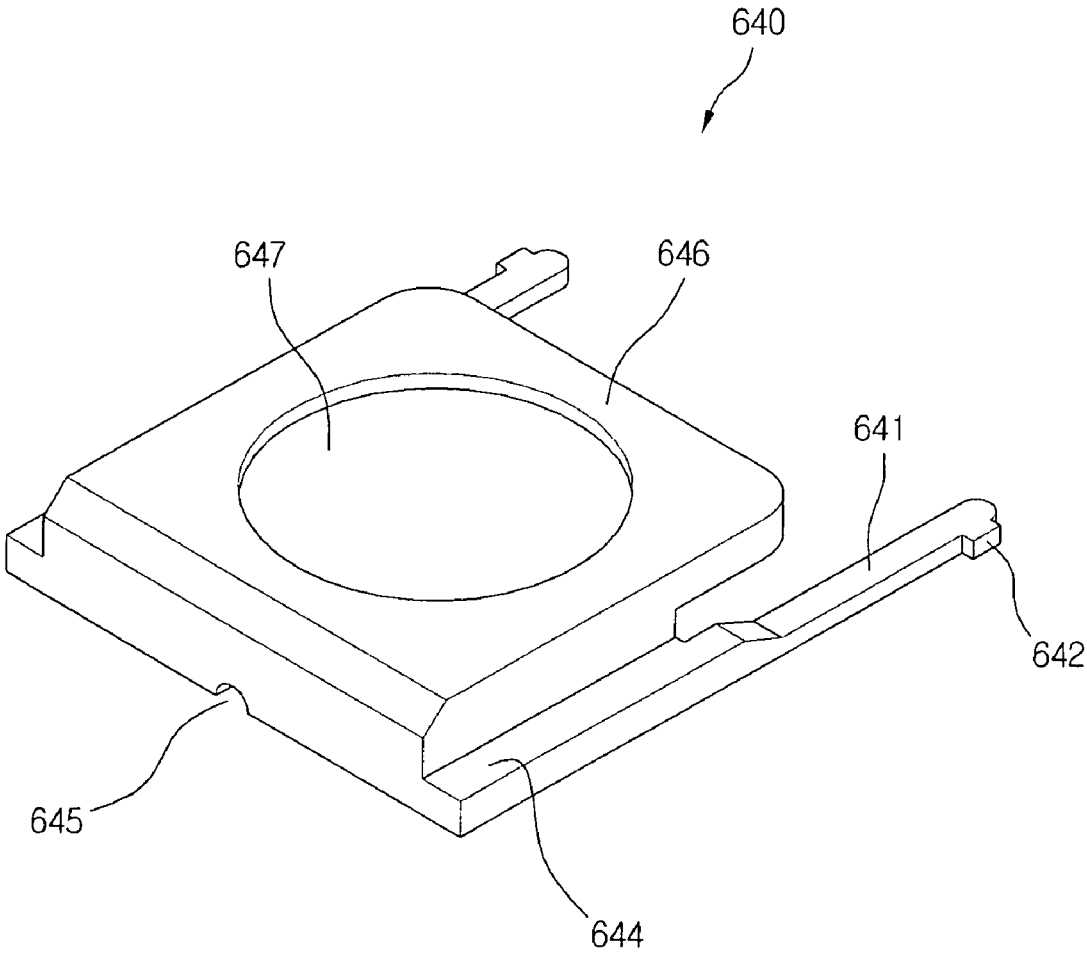
FIG. 15 is a front perspective view of a mounting/dismounting member depicted in FIG. 14.
Figure 16:
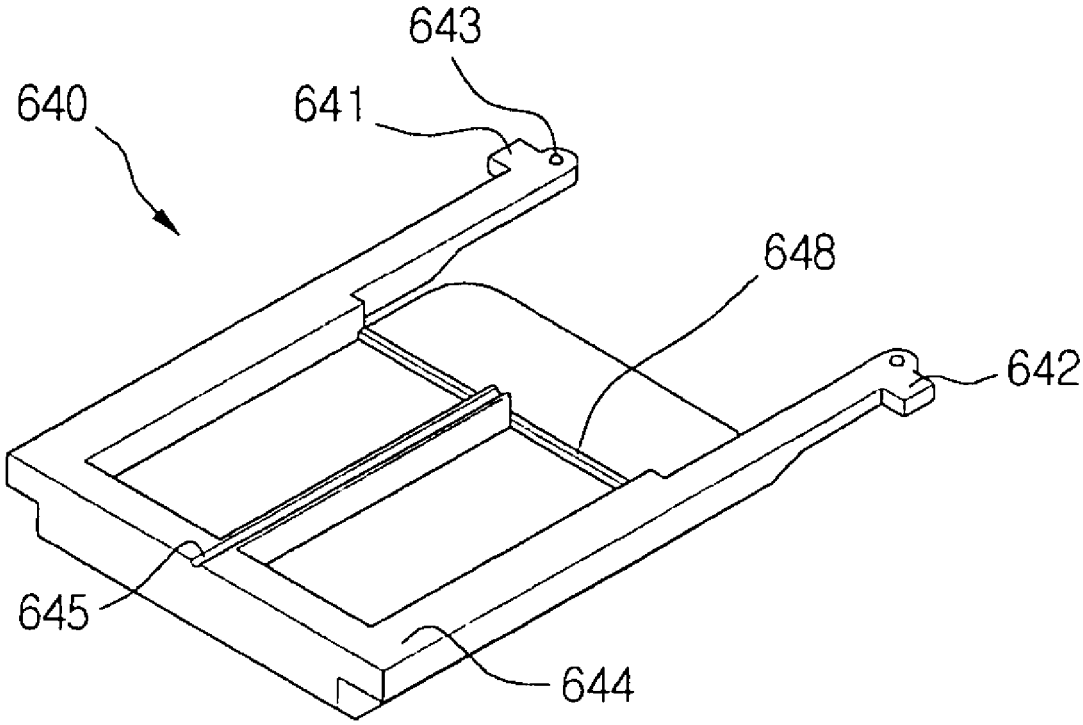
FIG. 16 is a rear perspective view of a mounting/dismounting member depicted in FIG. 14.

FIGS. 15 and 16 are respectively front and rear perspective views of the mounting/dismounting member.

Referring to FIGS. 15 and 16, the mounting/dismounting member 640 of this embodiment are guided by the guide ribs 621 and 622 formed on the rear surface of the outer case 620 to be inserted into the insertion portion 612 formed on the rear surface of the supporting panel 610.

That is, the mounting/dismounting member 640 is provided to fix the outer case 620 on the supporting panel 610. The mounting/dismounting member 640 includes a body 646 partly inserted in the insertion portion 612 of the supporting panel 610, slide portions 644 stepped at both sides, arms 641 extending from the slide portions 644 to be capable of elastically moving, a grasping groove 647 formed on a top surface of the body 646, and a guide groove 645 formed on a bottom of the body 646.

A stopper 642 is formed on an end of each arm 641. The stoppers 642 move between the insertion and withdrawal stoppers 623 and 624 of the outer case 620 to set the insertion and withdrawal limitations of the mounting/dismounting member 640.

A fixing projection 643 is formed on a bottom of the end portion of the arm 641 to be inserted in the insertion or withdrawal fixing grooves 625 or 626 formed on the outer case. That is, by the insertion of the fixing projection 643 into the insertion or withdrawal fixing groove 625 or 626, the inadvertent removal of the mounting member 640 from the outer case 620 can be prevented.

Also, the guide groove 645 formed on the rear center of the mounting/dismounting member 640 is formed between two ribs protruding from the bottom of the body 646. The center guide rib 622 of the outer case 620 is inserted into the guide groove 645 to guide the slide of the mounting/dismounting member 640.

Also, a limit setting rib 648 is formed at an end of the guide groove 645 in a direction perpendicular to a direction where the guide groove 645 is formed. The limit setting rib 648 extends from one side of the body 646 to the other side of the body 646.

Figure 17:
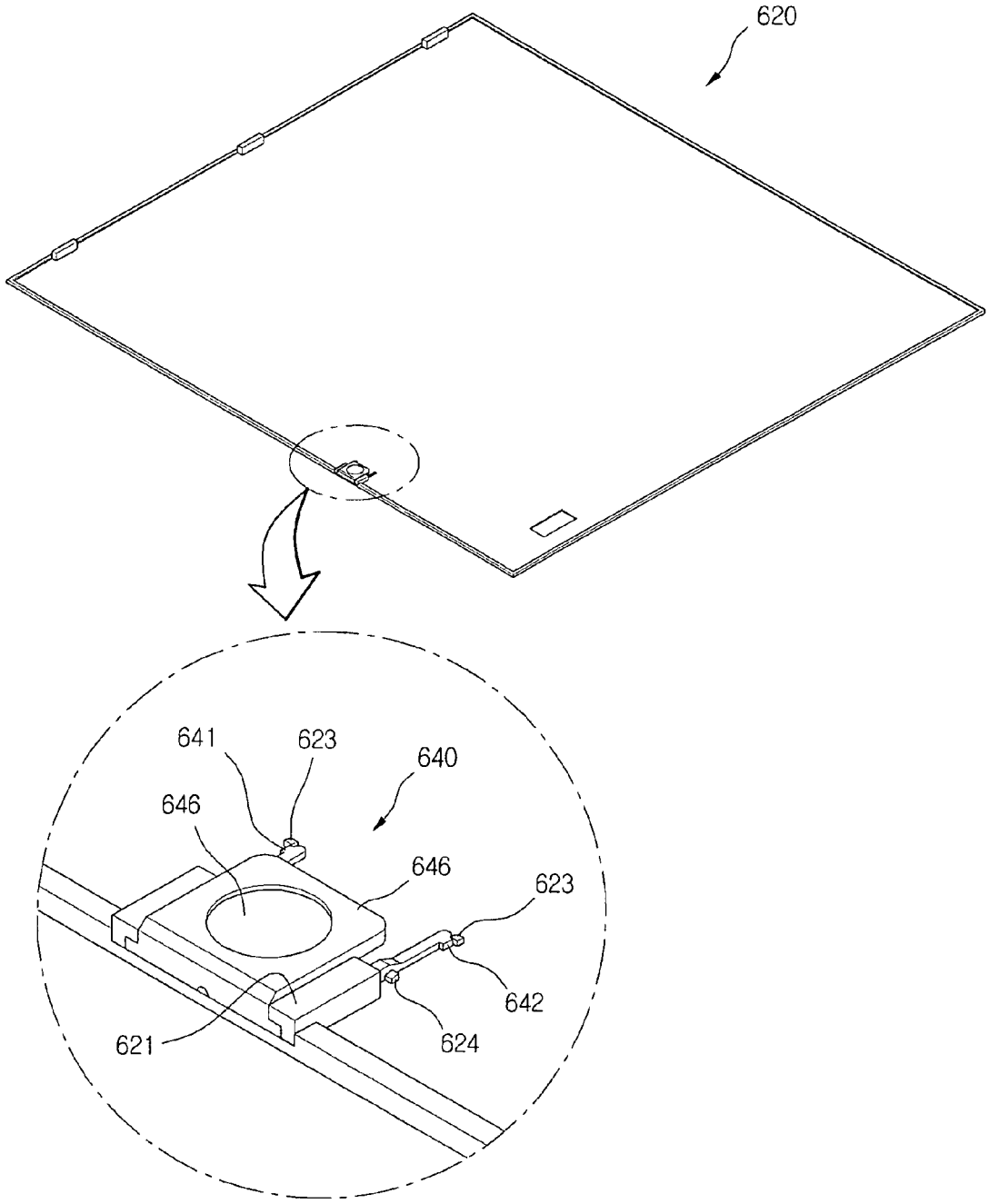
FIG. 17 is a view illustrating a position of a mounting/dismounting member when a supporting panel and an outer case are coupled to each other according to the present invention.
Figure 18:
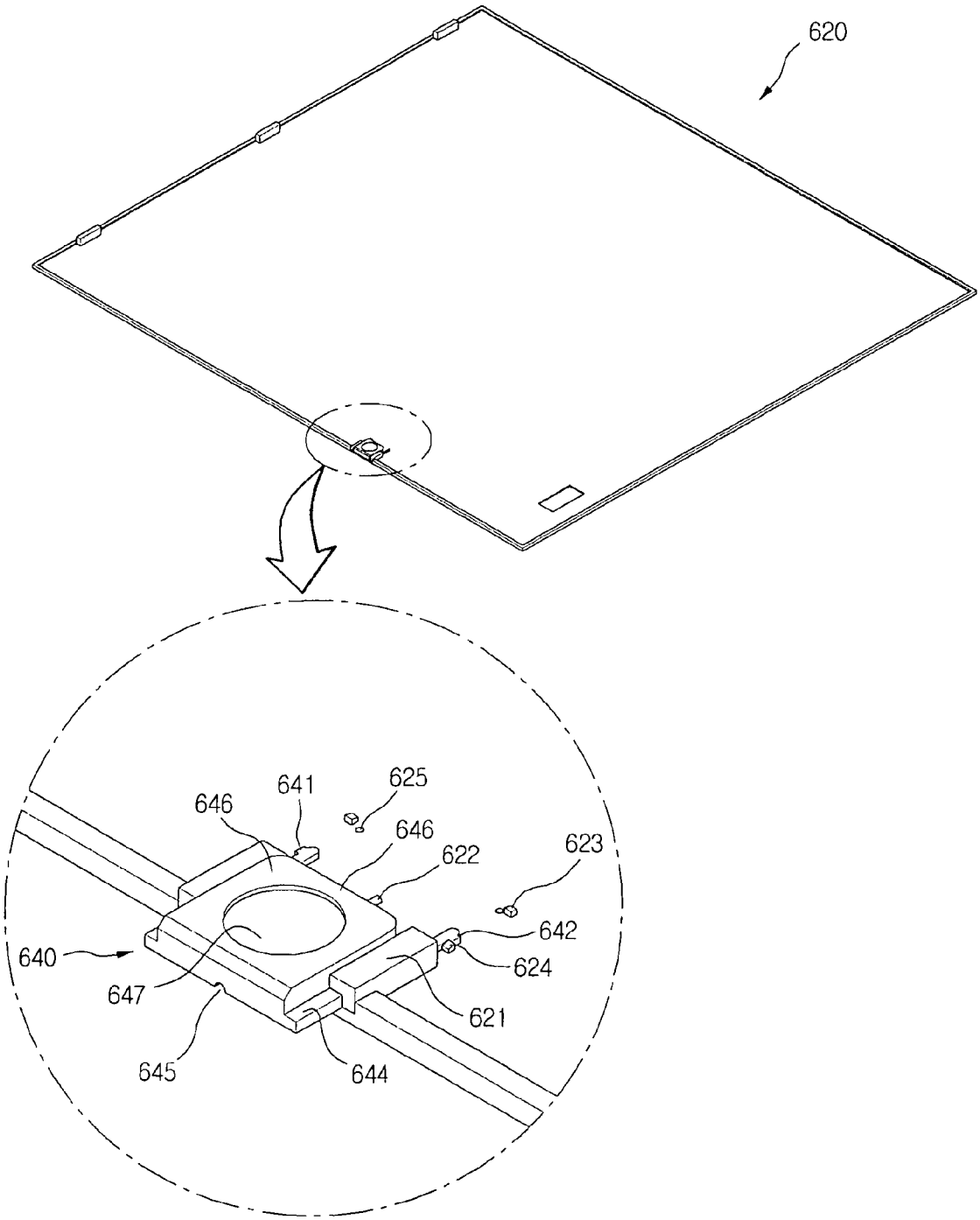
FIG. 18 is a view illustrating a position of a mounting/dismounting member when an outer case is in a state capable of being separated from a supporting panel.
Figure 19:
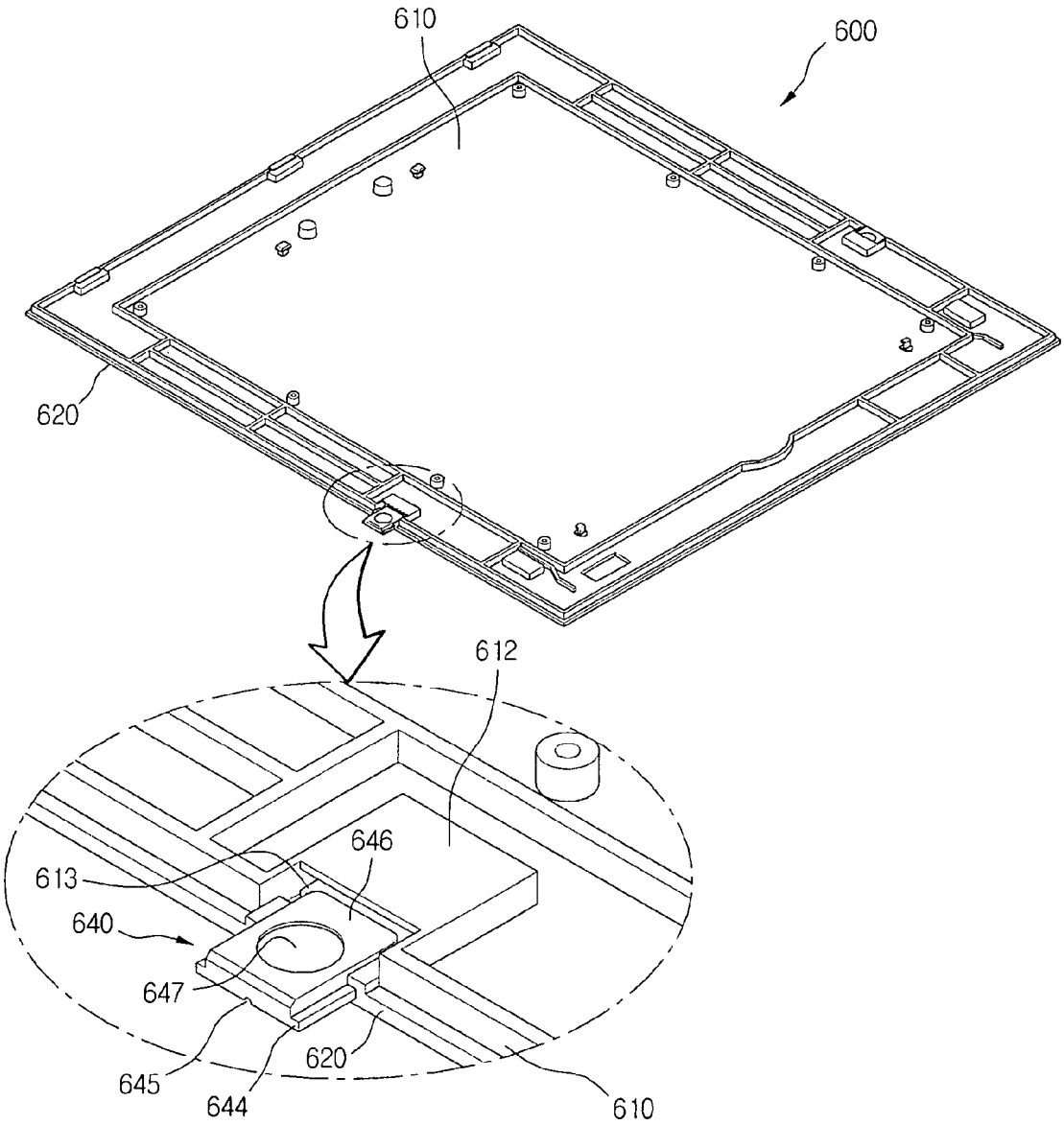
FIG. 19 is a view illustrating a process for coupling an outer case to a supporting panel using a mounting/dismounting member according to the present invention.

FIG. 17 is a view illustrating a position of the mounting/dismounting member when the supporting panel and the outer case are coupled to each other, FIG. 18 is a view illustrating a position of the mounting/dismounting member when the outer case is in a state capable of being separated from the supporting panel, and FIG. 19 is a view illustrating a process for coupling the outer case to the supporting panel using the mounting/dismounting member according to the present invention.

Referring to FIGS. 17 through 19, the slide portions 644 stepped on the both sides of the mounting/dismounting member 640 are inserted below the side guide rib 621 of the outer case 620. At this same time, the center guide rib 622 is inserted in the guide groove 645 of the mounting/dismounting member 640.

That is, in order to couple the outer case 620 to the supporting panel 610, a user pushes the mounting/dismounting member 640 into a rear center of the outer case 620. Then, the slide portions 644 formed on the mounting/dismounting member 640 are guided by the side guide rib 621 and the center guide rib 622 is guided by the guide groove 645. When the user further pushes the mounting/dismounting member 640 while pressing the grasping groove 647 into the center of the outer case 620, the stopper 642 formed on the outer end of the arm 641 contacts the withdrawal stopper 624. At this point, since the arm 641 has predetermined elastic force, the arm 641 is slightly bent inward the body 646 to pass over the withdrawal stopper 624. Then, the stopper 642 is located between the withdrawal stopper 624 and the insertion stopper 623.

In this state, when the user further pushes the body 646, a portion of the body 646 is inserted into the insertion portion of the supporting panel 610. The body 646 contacts the insertion stopper 612 of the supporting panel 610 and the limit setting rib 648 formed on the bottom of the mounting/dismounting member 640 is inserted into the insertion portion 612 until the limit setting rib 648 contacts the limiting setting rib 613 of the supporting panel 610.

Also, when the mounting/dismounting member 640 is fully inserted, the fixing projection 643 formed on the bottom of the end portion of the arm 641 is inserted in the insertion fixing groove 625. Therefore, in a state where the mounting/dismounting member 640 is fully inserted into the insertion portion 612, the mounting/dismounting member 640 is not inadvertently removed from the insertion portion 612.

Meanwhile, in order to separate the outer case 620 from the supporting panel 610, the user pulls the mounting/dismounting member 640 from the outer case 620. Then, the fixing projection 643 is removed from the insertion fixing groove 625. In addition, the slide portions 644 and the guide groove 645 that are formed on the mounting/dismounting member 640 are guided by the side and center guide ribs 621 and 622 formed on the outer case 620.

When the stopper 641 formed on the mounting/dismounting member 640 contacts the withdrawal stopper 624 and the mounting/dismounting member 640 is withdrawn until the fixing projection 643 is inserted in the withdrawal fixing groove 626, the outer case 620 is to be capable of being separated from the supporting panel 610. Therefore, even when the user excessively pulls the mounting/dismounting member 640, the mounting/dismounting member 640 is not completely removed from the outer case 620 by the withdrawal stopper 624 and the withdrawal fixing groove 626.

Figure 20:
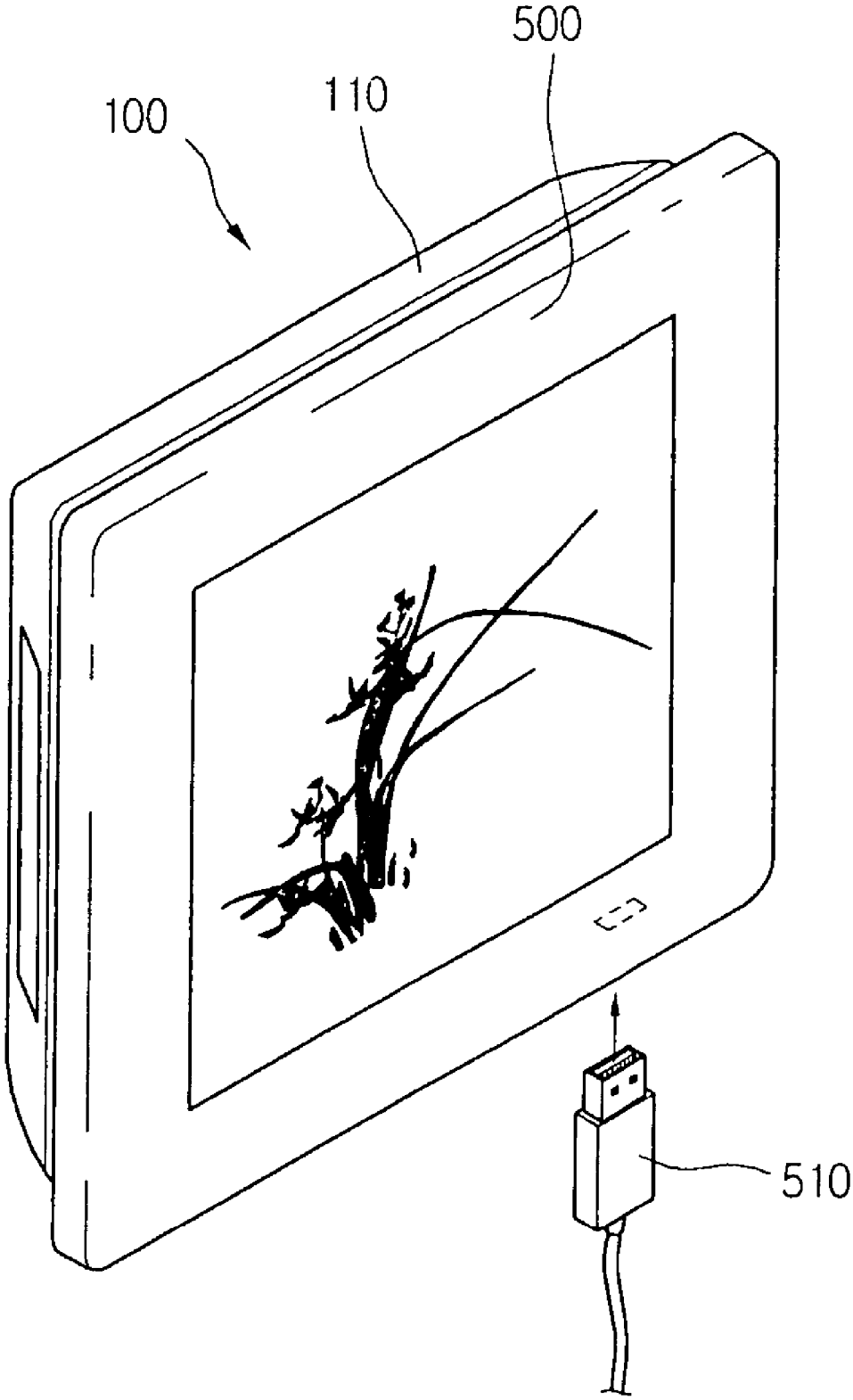
FIG. 20 is a perspective view of an indoor unit of an air conditioner according to a tenth embodiment of the present invention.

FIG. 20 is a perspective view of an indoor unit of an air conditioner according to a tenth embodiment of the present invention.

According to a feature of this embodiment, an LCD screen is mounted on a front portion of the main body 100. A cable for receiving digital information is connected to the LCD screen so that a variety of pictures and photographs can be displayed on the LCD display.

That is, an indoor unit of this embodiment includes a main body 110, a panel member 500 mounted on a front portion of the main body, and a cable 510 connected to the panel member 500.

As in the above-described embodiments, the panel member 500 may be assembled to be capable of reciprocating frontward and rearward or pivoting around a hinge shaft by a predetermined angle to define the air intake. In the case where the indoor unit is designed to introduce the air through its rear portion, the panel member 500 may be fixedly mounted on the main body 100. The cable 510 connected to the panel member 500 can be connected to a computer or a memory chip storing a variety of pictures and photographs. Since the panel member 500 may be formed of an LCD monitor and connected to the computer or memory chip, there is no need of replacing or disposing the art panel having the picture or photograph. Furthermore, by upgrading the memory chip, the great number of pictures and photographs can be displayed through the LCD monitor. That is, by allowing the pictures and photographs to be displayed through a slideshow, the interior atmospheric effect can be further improved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An air conditioner comprising:

a main body;

a front panel mounted on a front portion of the main body, the front panel having an edge which is hingedly connected to the main body to open and close an air inlet; an air filter located rearwardly of said front panel; and an art panel mounting unit located in front of the front panel, wherein the art panel mounting unit comprises:

a front cover hingedly connected to the front panel; and an art panel having a picture or a photograph, wherein the front cover is hingedly connected to the front panel in order to interchange the art panel.

2. The air conditioner according to claim 1, wherein the art panel mounting unit is separable from the front panel.

3. The air conditioner according to claim 1, further comprising a mounting/dismounting member for fixing the front cover on the front panel.

4. The air conditioner according to claim 1, wherein the front cover includes a transparent window to allow the art panel to be seen, and the art panel is mounted on a surface which is recessed in a front of the front panel.

5. The air conditioner according to claim 4, wherein the front cover closely contacts the front panel by magnets.

6. The air conditioner according to claim 1, wherein the front cover further comprises a transparent window.

7. The air conditioner according to claim 6, further comprising a pivotal shaft provided on a portion of an edge of the front panel to pivotally mount the front cover on the front panel and a fixing member formed on another portion of the edge of the front panel and on a front portion of the front cover to fix the art panel mounting unit.

8. The air conditioner according to claim 1, wherein the art panel mounting unit further comprises a window, a supporting panel coupled to the window, and a hook member provided on a rear portion of the supporting panel to detachably attach the supporting panel to the front panel, and the art panel is inserted between the window and the supporting panel.

9. The air conditioner according to claim 8, wherein the art panel mounting unit further comprises a side frame coupled to edges of the window and the supporting panel.

10. The air conditioner according to claim 9, wherein the side frame is formed a plurality of sections and one of the sections is designed to be separable from the edges of the window and the supporting panel.

11. The air conditioner according to claim 1, further comprising a rack gear provided on a rear portion of the front cover, a pinion gear engaged with the rack gear and inserted inside the front panel, and a driving motor coupled to the pinion gear to provide driving force to the pinion gear.

12. The air conditioner according to claim 1, wherein the front panel is hingedly connected to the main body along a bottom edge of the front panel and the front cover is hingedly connected to the front panel along a side edge of the front panel.

* * * * *